US008573312B2

(12) United States Patent
Sonnier

(10) Patent No.: US 8,573,312 B2
(45) Date of Patent: Nov. 5, 2013

(54) APPARATUS FOR APPLYING AN AXIAL FORCE TO WELL PIPE SLIPS

(75) Inventor: Errol A Sonnier, Broussard, LA (US)

(73) Assignee: Tesco Corporation, Houston, TX (US)

( * ) Notice: Subject to any disclaimer, the term of this patent is extended or adjusted under 35 U.S.C. 154(b) by 404 days.

(21) Appl. No.: 12/977,173

(22) Filed: Dec. 23, 2010

(65) Prior Publication Data

US 2012/0160518 A1 Jun. 28, 2012

(51) Int. Cl.
*E21B 19/00* (2006.01)

(52) U.S. Cl.
CPC ..... *E21B 19/00* (2013.01)
USPC ..... 166/382; 166/77.52; 166/77.1; 166/88.2

(58) Field of Classification Search
USPC ..... 166/382, 77.52, 77.1, 88.2; 175/423
See application file for complete search history.

(56) References Cited

U.S. PATENT DOCUMENTS

| | | | | | |
|---|---|---|---|---|---|
| 2,612,671 | A | * | 10/1952 | Martin | 188/67 |
| 3,096,075 | A | * | 7/1963 | Brown | 254/29 R |
| 5,732,909 | A | | 3/1998 | Sonnier | |
| 5,992,801 | A | | 11/1999 | Torres | |
| 6,131,664 | A | | 10/2000 | Sonnier | |
| 6,199,641 | B1 | | 3/2001 | Downie | |
| 6,279,662 | B1 | | 8/2001 | Sonnier | |
| 7,681,649 | B2 | | 3/2010 | Cerovsek | |

* cited by examiner

*Primary Examiner* — Cathleen Hutchins
(74) *Attorney, Agent, or Firm* — Bracewell & Giuliani LLP

(57) ABSTRACT

An apparatus for gripping a string of well pipe being lowered into or retrieved from a well includes pipe slips defining a central bore opening having an axis. The pipe slips are configured to abut and grip a surface of a pipe passing through the central bore opening while the pipe slips are in a first position. The pipe slips are further configured to allow axial movement of the pipe when moved to a second position. The apparatus includes at least one hydraulic ram device configured to exert an axial force on the pipe slips while the pipe slips are in the first position to enhance gripping of the pipe.

19 Claims, 6 Drawing Sheets

APPARATUS FOR APPLYING AN AXIAL FORCE TO WELL PIPE SLIPS

BACKGROUND OF THE INVENTION

1. Field of the Invention

The present invention relates in general to a method and apparatus for placing a pipe string in a well and, in particular, to an apparatus and method for gripping a pipe string during placement within a well.

2. Brief Description of Related Art

Drilling operations use gripping assemblies to manipulate pipe strings into and out of a well. Gripping assemblies generally consist of pipe slips and the associated equipment needed to operate the pipe slips. This equipment is configured to variably engage and hold a pipe string passing through an opening defined by the pipe slips. Generally, the pipe slips have a surface approximately parallel to an axis of the pipe string being manipulated. These pipe slip surfaces are moved into and out of contact with the surface of the pipe string to alternately grip and release the pipe. The gripping assembly grips and holds the pipe string while the pipe string is moved or while additional pipe or objects are attached to or removed from the pipe string.

Some gripping assemblies require multiple movable gripping assemblies to effectively grip and hold a pipe string while additional pipe is added to or removed from the pipe string. In these systems, there is a complicated choreography of movement between at least two movable gripping assemblies. A first holds the pipe string while a second brings a new pipe element to be coupled to the pipe string. Following coupling, the second holds the pipe string via the new pipe element while the first releases the pipe string and is moved to procure another pipe element. The first then brings the pipe element over to the pipe string where the process repeats. In practice, this is a complicated process with many moving parts that can damage the pipe string, pipe elements, and potentially the workers orchestrating the process. In addition, the constant changing between gripping assemblies often misaligns the pipe string relative to the wellbore. Therefore, there is a need for a gripping assembly that uses only one movable gripping assembly.

Many times, the pipe slip surfaces have a series of protrusions, i.e. pipe slip teeth, on the surface adjacent to the pipe string. These pipe slip teeth are moved into contact with the pipe string surface, and the pipe string is then lowered to engage the pipe slip teeth into the surface of the pipe. In this manner, the pipe string is held in place by the pipe slip teeth. Unfortunately, the pipe slip teeth may mar and damage the pipe string at the point of contact between the pipe slip teeth and the pipe string. After additional pipe is added to the pipe string, the gripped portion of the pipe string is then lowered further into the well; thus, the damaged portion of the pipe string becomes exposed to the harsh environment of the well. The damaged portion then becomes a point of failure as the pipe string is more likely to corrode and fail at the location where the pipe slip teeth gripped the pipe string. This problem is exacerbated if the pipe in the pipe string is specially coated because the pipe slip teeth may dig into and remove portions of the coating at the point of contact. Thus, there is a need for a gripping assembly that can grip a pipe string without the use of pipe slip teeth.

Some attempts to overcome the problems caused by pipe slip teeth use smooth faced surface pipe slips at the point of contact with the pipe string. The smooth faced surface pipe slips are coupled to complex systems designed to exert a substantial radial force on the surface of the pipe string. Due to the complexity of such systems, they are difficult to produce and maintain. In addition, the complexity significantly increases the costs of the equipment needed to drill a well and turn the well to production. Furthermore, current smooth faced surface pipe slip systems must use a friction paper interposed between the pipe string and the pipe slips. The friction paper helps set the pipe string within the pipe slips. However, the friction paper also binds and can interfere with the gripping assembly. In some cases, friction paper binding can deform the surface of the pipe string. Therefore, there is a need for a smooth faced pipe slip system for gripping pipe strings that makes use of simpler means to exert a sufficient radial force on the pipe string without the use of friction paper.

Other attempts to overcome the problem pair simpler smooth faced surface pipe slip systems with a backup pipe slip system using pipe slip teeth. These systems first pass the pipe string through a primary smooth faced surface pipe slip system and then through a secondary pipe slip system using pipe slip teeth. Because the primary system is backed up, the associated equipment used to exert a radial force on the pipe slips does not need to be as robust. When the primary system fails, the secondary system will then engage and prevent the pipe string from slipping further into the well. While these devices overcome the complexity problems of other smooth faced surface pipe slip systems, many times they are unable to exert the necessary radial force against the pipe string leading to frequent failure. When the primary system fails to adequately grip and hold the pipe string and the pipe string begins to slip, the movement of the pipe string will force the pipe slip teeth of the backup system into the pipe string, preventing the pipe string from falling too far and doing too much damage. However, some damage will occur to the pipe string before the backup pipe slip teeth halt and re-grip the pipe string. This also may cause the pipe string to be misaligned in the well. In addition, the lack of necessary radial force limits the weight of the pipe string that the gripping assembly can support. Therefore, there is a need for a smooth faced surface pipe slip system that does not use a backup system with pipe slip teeth.

SUMMARY OF THE INVENTION

These and other problems are generally solved or circumvented, and technical advantages are generally achieved, by preferred embodiments of the present invention that provide a mark free set, and a method for using the same.

In accordance with an embodiment of the present invention, an apparatus for gripping a string of well pipe being lowered into or retrieved from a well comprises pipe slips defining a central bore opening having an axis. The pipe slips are configured to abut and grip a surface of a pipe passing through the central bore opening while in a first position and to allow axial movement of the pipe when moved to a second position. Finally, the apparatus comprises at least one hydraulic ram device configured to exert an axial force on the pipe slips while the pipe slips are in the first position, the hydraulic rain device enhancing gripping of the pipe.

In accordance with another embodiment of the present invention, an apparatus for assisting support of well pipe being lowered into or retrieved from a well comprises a load ring for encircling a set of well pipe slips, and a setting plate defining an opening coaxial with an axis of the load ring. The apparatus further comprises a plurality of axially oriented hydraulic rams connected between the setting plate and the load ring for moving the setting plate axially relative to the load ring. The hydraulic rams are spaced around the opening in the setting plate. Finally, the apparatus comprises at least one setting plate extension coupled to the setting plate. The setting plate extension has an end configured to engage and exert an axial force on the pipe slips in response to axial movement of the hydraulic rams.

In accordance with yet another embodiment, a method for gripping well pipe being run into a well comprises the steps of providing pipe slips defining a central bore opening having an axis and placing the pipe slips in a first position. Then, the method lowers a pipe into the central bore opening while the pipe slips are in the first position. Next, the method moves the pipe slips to a second position in abutment with the pipe. Finally, with a hydraulic ram device, the method exerts an axial force on the pipe slips, tightly gripping the pipe.

An advantage of a preferred embodiment is that the apparatus provides a pipe slip assembly that can grip pipe without the use of pipe slip teeth or friction paper. In addition, the present invention accomplishes this without the need of a secondary gripping system that uses damaging pipe slip teeth. The preferred embodiment also eliminates the need for multiple movable gripping assemblies. This allows the run-in process to be accomplished with more efficiency and safety. The hydraulic ram system also allows use of heavier weight pipe strings due to the additional gripping force exerted by the pipe slips through the hydraulic rams. Embodiments of the present invention can also be used with the conventional control line installation systems.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning drilling rig operation, materials, and the like have been omitted inasmuch as such details are not considered necessary to obtain a complete understanding of the present invention, and are considered to be within the skills of persons skilled in the relevant art.

Figure 1:
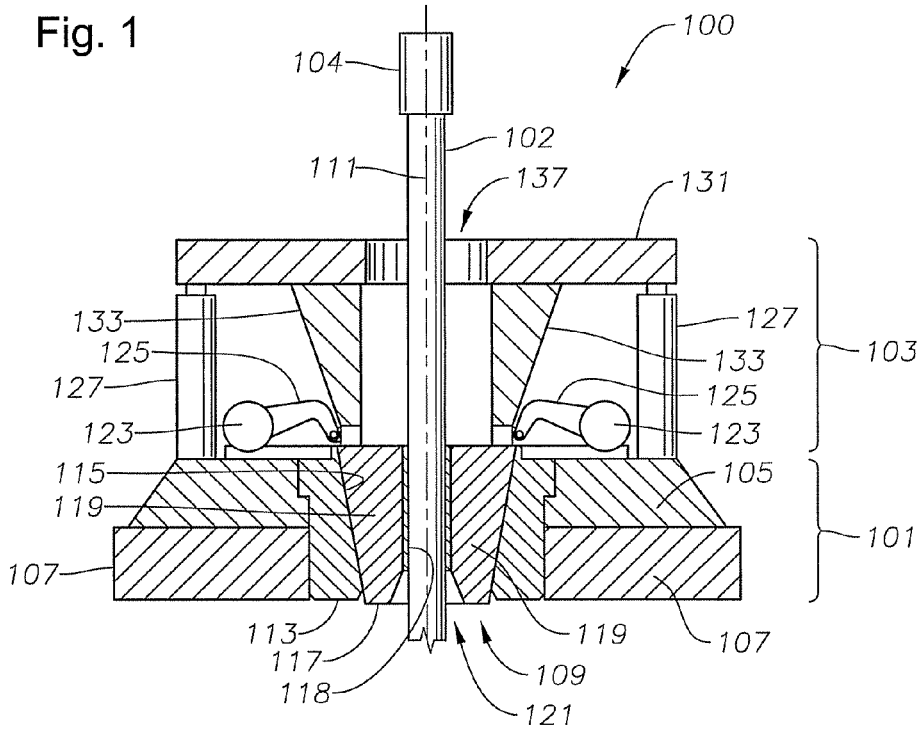
FIG. 1 is sectional view of a pipe gripping assembly in accordance with an embodiment of the present invention.
Figure 2:
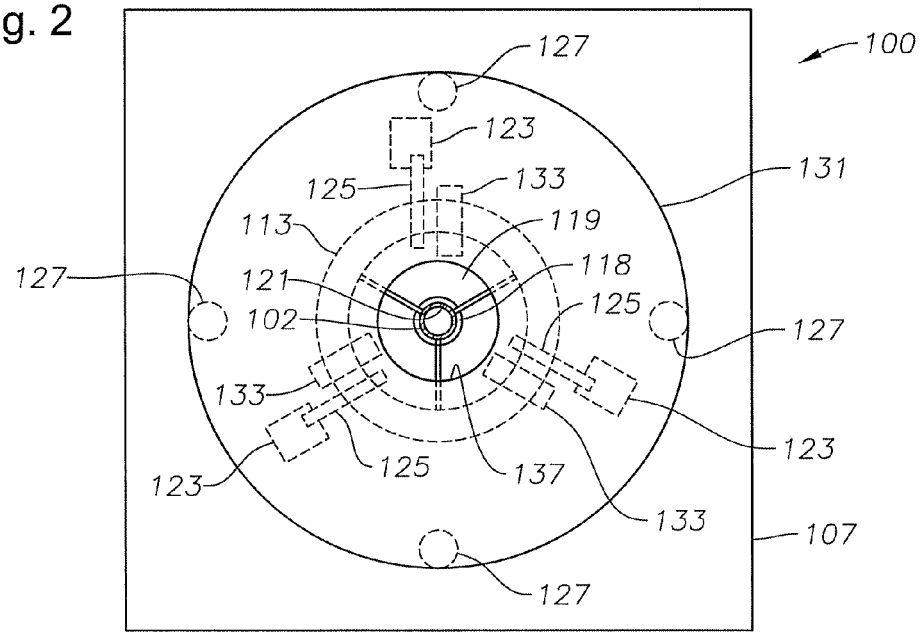
FIG. 2 is a top view of the pipe gripping assembly of FIG. 1.

Referring to FIG. 1 and FIG. 2, pipe gripping assembly 100 comprises a working platform 101 and a ram assembly 103. Further illustrated in FIG. 1 is a portion of a pipe string 102 having a collar 104. Pipe string 102 may comprise drill pipe, casing, or tubing, all of which are normally formed of steel. Working platform 101 comprises a load ring 105 and a load plate 107. Load ring 105 and load plate 107 define a central opening 109 having an axis 111. A bushing 113 inserts into central opening 109, substantially filling a portion of central opening 109. Bushing 113 defines an inner tapered surface 115 extending from an upper surface of load ring 105 to a lower surface of load plate 107. Tapered surface 115 defines an inverse conical opening having a larger diameter at the upper surface of load ring 105 and a smaller diameter at the lower surface of load plate 107.

As illustrated in FIG. 1, a tapered slip bowl 117 inserts into the opening defined by tapered surface 115. In the preferred embodiment, tapered slip bowl 117 comprises three pipe slips 119 coupled together to define a pipe opening 121 coaxial with axis 111 (see FIG. 2). A person skilled in the art will understand that tapered slip bowl 117 could comprise more or fewer pipe slips 119. For example in an alternative embodiment, tapered slip bowl 117 comprises four pipe slips 119. A plurality of pipe slip inserts 118 (see FIG. 2) optionally may couple to the interior surfaces of pipe slips 119 defining pipe opening 121. Each pipe slip insert 118 of the plurality of pipe slip inserts 118 comprises a substantially smooth surface proximate to and exposed to pipe opening 121. Preferably, pipe slip inserts 118 are formed of a material softer than the steel material of pipe string 102, such as a T6061 aluminum alloy or the like. A person skilled in the art will understand that the surface of the pipe slip insert 118 proximate to and exposed to pipe opening 121 may comprise teeth, friction paper, or some other non-smooth surface.

Hydraulic actuators 123 couple to the upper surface of load ring 105. Each respective cylinder motor 123 further couples to a respective pipe slip 119 of the tapered slip bowl 117 by means of a respective pipe slip coupler 125. Each cylinder motor 123 operates to alternately lower the respective coupled pipe slip 119 within central opening 109 and to lift the respective coupled pipe slip 119 upward within central opening 109. When lifted the slips 119 disengage from pipe string 102. Hydraulic actuators 123 are operationally coupled such that during lowering and raising of each pipe slip 119, adjacent pipe slips 119 will not bind or otherwise interfere. A person skilled in the art will understand that hydraulic actuators 123 are not capable of exerting a downward axial force along axis 111 to force pipe slips 119 more tightly against tapered surface 115. A person skilled in the art will also understand that more or fewer hydraulic actuators 123 may be used depending on the type of tapered slip bowl 117 used, and the number of pipe slips 119. For example, in alternative embodiments tapered slip bowl 117 comprises four pipe slips 119; correspondingly, a separate cylinder motor 123 couples to each of the four pipe slip 119. In still other embodiments, pipe slips 119 of tapered slip bowl 117 may be coupled such that use of only one cylinder motor 123 is necessary.

Ram assembly 103 comprises, in the preferred embodiment, four lifting devices 127, a setting platform 131, and three setting extensions 133. As illustrated in FIG. 1, a lower end of each lifting device 127 is coupled to the upper surface of load ring 105, near an edge of load ring 105 circumferentially equidistant from the two adjacent lifting devices 127. A corresponding upper end of each lifting device 127 is coupled to a lower surface of setting platform 131, near an edge of setting platform 131 circumferentially equidistant from the two adjacent lifting devices 127. Preferably, lifting devices 127 comprise 3 inch hydraulic rams having a 1.5 inch rod capable of lifting setting platform 131 approximately 1.5 feet. Lifting devices 127 are operationally coupled such that during operation of the ram assembly 103, setting platform 131 will remain level. The lifting power of each individual lifting device 127 is selected based on the particular pipe slips 119, and the particular pipe string 102 in use in a particular application. A balance must be maintained between the force necessary to appropriately raise and lower setting platform 131, the force necessary to set pipe string 102 in pipe slips 119, and the crush strength of pipe slips 119 and pipe string 102. A person skilled in the art will understand that more or fewer lifting devices 127 may be used provided that the axial force along axis 111 exerted against each pipe slip 119 is the same without overloading any individual pipe slip 119. Furthermore, a person skilled in the art will understand that lifting devices 127 may comprise other types of lifting devices such as screw lifts or the like.

Setting platform 131 couples to lifting devices 127 opposite load ring 105 as described above such that setting platform 131 may alternately move axially upward and downward along axis 111 to points of maximum and minimum lift of lifting devices 127. Setting platform 131 and lifting devices 127 are at a point of minimum lift in FIG. 1. Setting platform 131 defines an opening 137 configured to allow for pipe string 102 to pass and move through setting platform 131. Setting extensions 133 couple to a lower surface of setting platform 131 and extend toward the upper surface of load ring 105. Setting extensions 133 have a sufficient vertical length such that when lifting devices 127 are at minimal lift, a lower end of each setting extension 133 contacts a respective top of each pipe slip 119 of tapered slip bowl 117, exerting an axial force downward on tapered slip bowl 117. Setting extensions 133 may be tapered toward the end proximate to load ring 105 as illustrated in FIG. 1, or alternatively not. There are three setting extensions 133 in the embodiment illustrated in FIG. 2; a setting extension 133 corresponds to each pipe slip 119 in use in tapered slip bowl 117. A person skilled in the art will understand that alternative embodiments of tapered slip bowl 117 may comprise more or fewer pipe slips 119. In those embodiments, more or fewer setting extensions 133 will be used. For example, in embodiments where tapered slip bowl 117 comprises four pipe slips 119, four setting extensions 133 will be used, one setting extension 133 proximate to and configured to engage each pipe slip 119.

Referring now to FIGS. 3-6, gripping assembly 100 operates as described herein. In the running process illustrated in FIG. 3, a movable assembly 200, namely an elevator, supports a pipe string 102 in central opening 109. Elevator 200 is raised and lowered within a derrick of the drilling rig. Hydraulic actuators 123 have operated to lift pipe slips 119 out of central opening 109 allowing for axial movement of pipe string 102 within central opening 109. In addition, lifting devices 127 have operated to raise setting platform 131 to the maximum lift of lifting devices 127.

Figure 4:
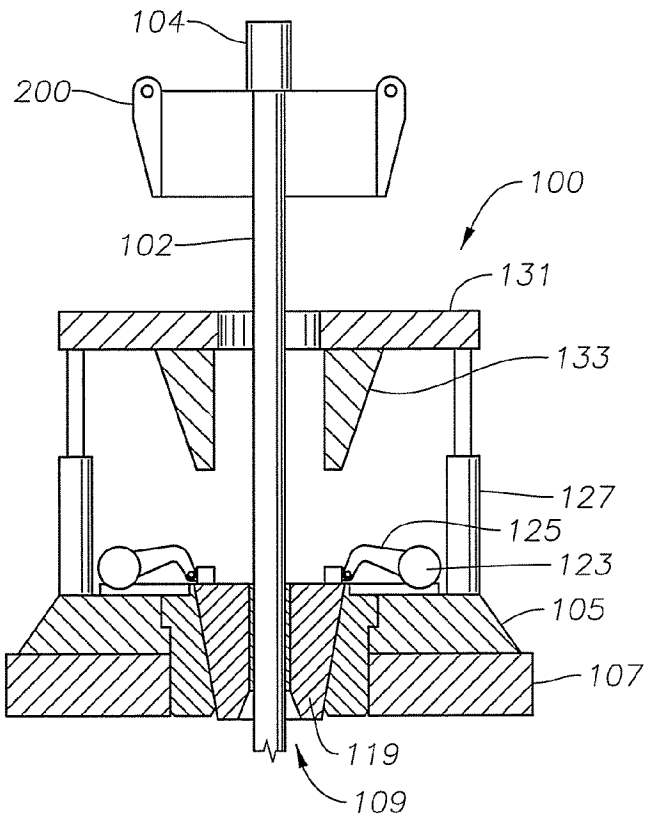
FIGS. 3-6 are sectional views of the pipe gripping assembly of FIG. 1 illustrating sequential steps in the operation of the pipe gripping assembly of FIG. 1.
Figure 3:
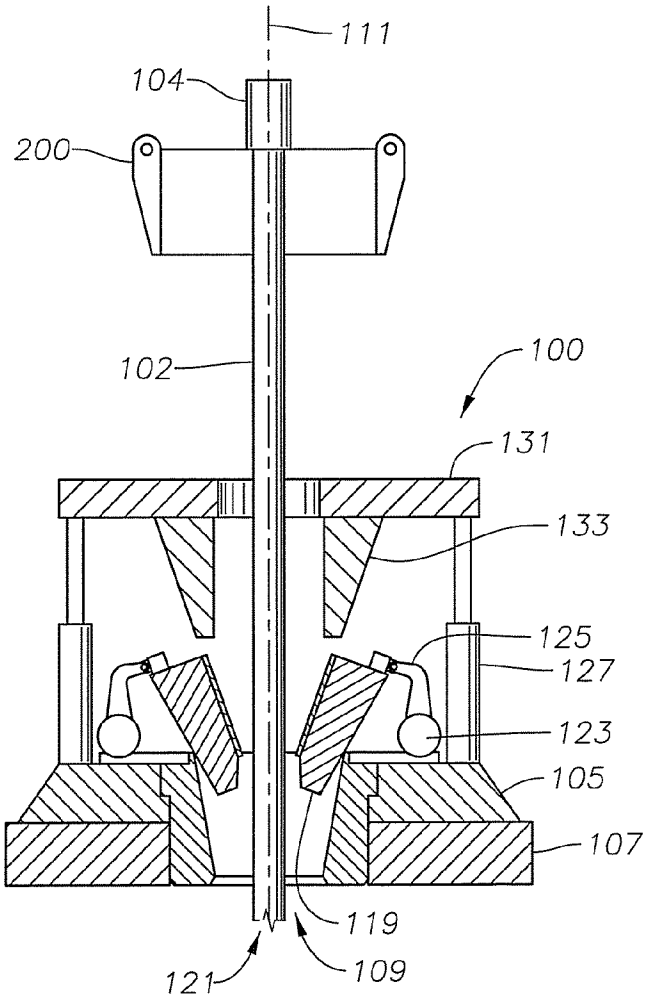

As illustrated in FIG. 4, movable assembly 200 then lowers pipe string 102 axially along axis 111 bringing collar 104 proximate to setting platform 131. Hydraulic actuators 123 are then operated again to insert pipe slips 119 into central opening 109 and define pipe opening 121. As shown, pipe string 102 substantially fills pipe opening 121. Operation of hydraulic actuators 123 as shown in FIG. 4 brings the pipe slip inserts 118 (FIG. 2) in pipe slips 119 into contact with the surface of pipe string 102, providing initial grip of pipe string 102.

Figure 5:
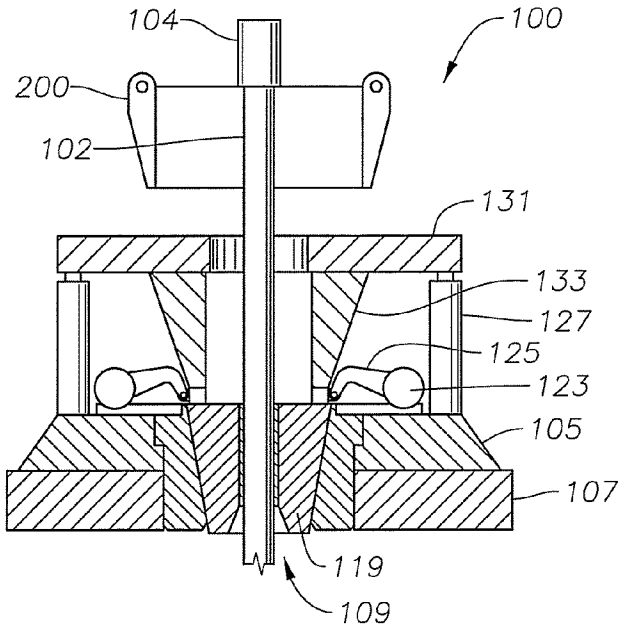

Referring now to FIG. 5, lifting devices 127 are operated, thus lowering setting platform 131. Lowering of setting platform 131 brings a respective setting extension 133 into contact with a respective upper surface of each pipe slip 119. Continued operation of lifting devices 127 exerts an axial force downward along axis 111 through setting extensions 133 against pipe slips 119. This action forces pipe slips 119 axially downward, narrowing the diameter of pipe opening 121. In response, the pipe slip inserts 118 (FIG. 2) come into tighter gripping contact with pipe string 102. In some instances, pipe slip inserts 118 (FIG. 2) deform to the surface of pipe string 102. In this manner, gripping assembly 100 comes into gripping engagement with pipe string 102. Gripping assembly 100 exerts a greater gripping force on pipe string 102 than prior art methods without requiring the use of pipe slip inserts containing teeth or friction paper proximate to pipe string 102.

Figure 6:
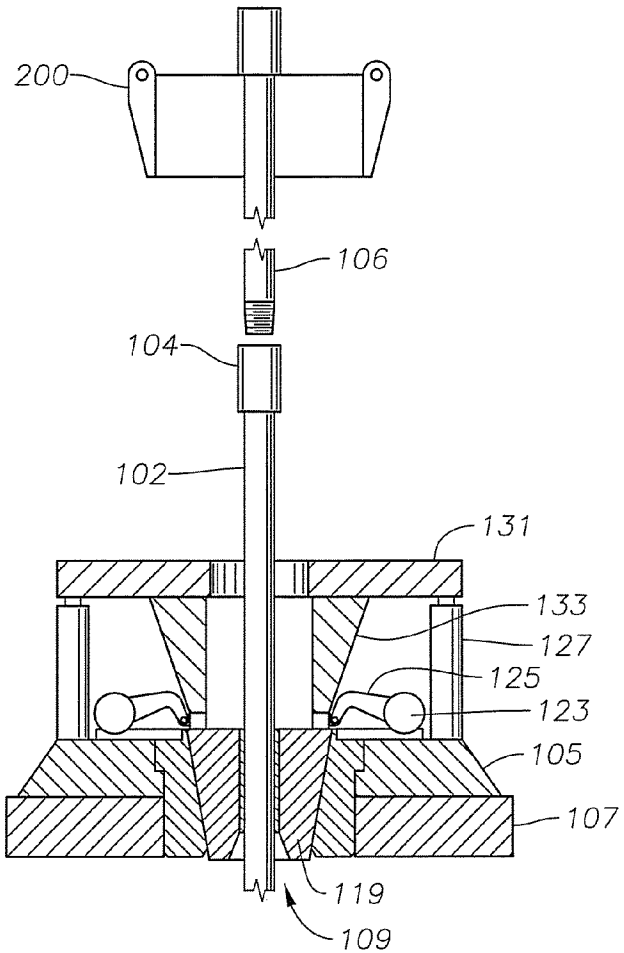

Referring now to FIG. 6, movable assembly 200 releases pipe string 102, placing the entire weight of pipe string 102 on gripping assembly 100. Movable assembly 200 then retrieves an additional pipe element 106. The additional pipe element 106 is coupled to pipe string 102 through collar 104, securing movable assembly 200 to pipe string 102. Lifting devices 127 are then operated to raise setting platform 131, removing setting extensions 133 from contact with pipe slips 119. This also removes the downward axial force from pipe slips 119. Hydraulic actuators 123 are then operated to remove pipe slips 119 from central opening 109, allowing movable assembly 200 to lower pipe string 102 further into a bore. The process then repeats itself beginning as described in FIG. 3.

Figure 7:
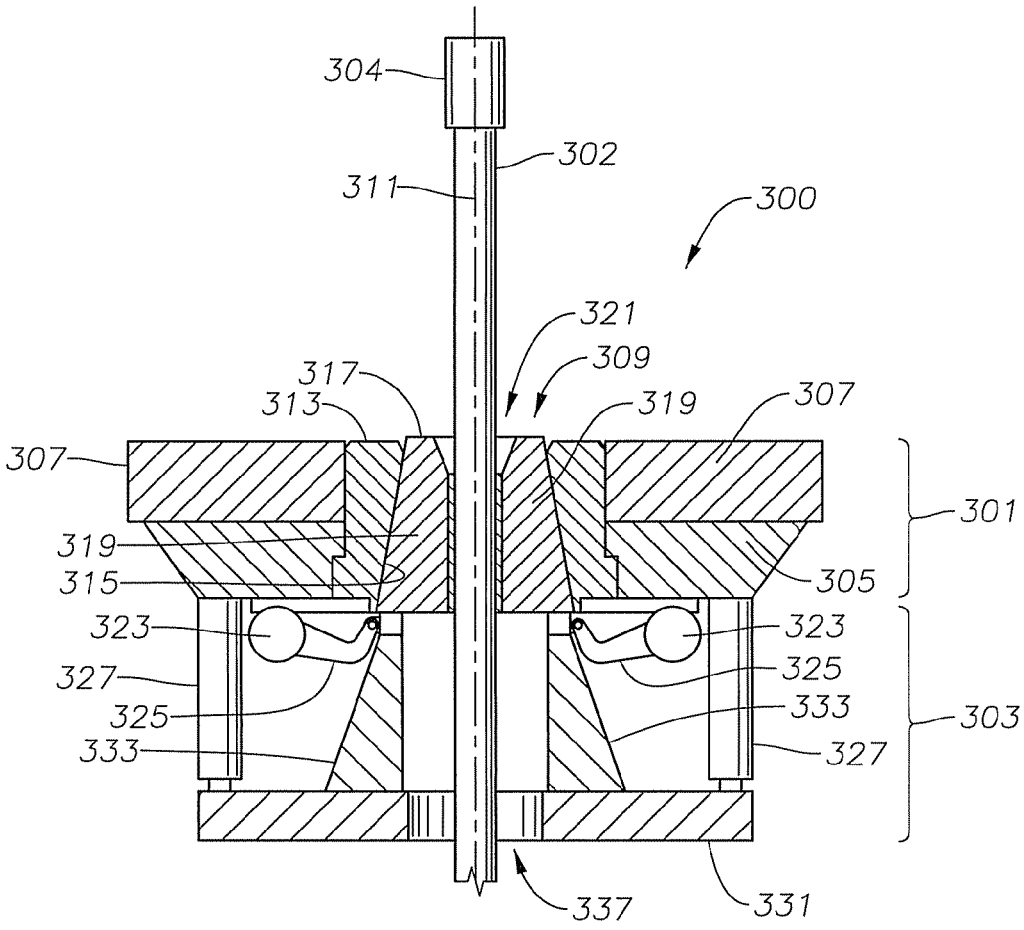
FIG. 7 is a sectional view of a pipe gripping assembly of an alternative embodiment of the present invention.

FIG. 7 illustrates an alternate embodiment of the present invention used in a snubbing operation where the gripping assembly must overcome well pressure acting to force the pipe string out of the wellbore. Pipe gripping assembly 300 comprises a working platform 301 and a ram assembly 303. Further illustrated in FIG. 7 is a portion of a pipe string 302 having a collar 304. Working platform 301 comprises a load ring 305 and a load plate 307. Load ring 305 and load plate 307 define a central opening 309 having an axis 311. A bushing 313 inserts into central opening 309, substantially filling a portion of central opening 309. Bushing 313 defines a tapered surface 315 extending from a lower surface of load ring 305 to an upper surface of load plate 307. Tapered surface 315 defines a conical opening having a larger diameter at the lower surface of load ring 305 and a smaller diameter at the upper surface of load plate 307.

As illustrated in FIG. 7, a tapered slip bowl 317 inserts into the opening defined by tapered surface 315. Tapered slip bowl 317 comprises a plurality of pipe slips 319 coupled together to define a pipe opening 321 coaxial with axis 311. Similar to gripping assembly 100 of FIG. 1, gripping assembly 300 of FIG. 3 includes a plurality of pipe slip inserts (not shown) coupled to the interior surfaces defining pipe opening 321. Each pipe slip insert of the plurality of pipe slip inserts comprises a substantially smooth surface proximate to and exposed to pipe opening 321. Preferably, pipe slip inserts comprise a T6061 aluminum alloy or the like which is softer than the metal of pipe string 302. A person skilled in the art will understand that the pipe slip insert surface proximate to and exposed to pipe opening 321 may comprise teeth, friction paper, or some other non-smooth surface.

Hydraulic actuators 323 couple to the lower surface of load ring 305. A respective cylinder motor 323 further couples to a respective pipe slip 319 of the tapered slip bowl 317 by means of a respective pipe slip coupler 325. Each cylinder motor 323 operates to alternately insert the respective coupled pipe slip 319 into central opening 309 and remove the respective coupled pipe slip 319 out of central opening 309. Hydraulic actuators 323 are operationally coupled such that during removal and insertion of pipe slips 319, adjacent pipe slips 319 will not bind or otherwise interfere. A person skilled in the art will understand that hydraulic actuators 323 are not capable of exerting an axial force along axis 311 to force pipe slips 319 against tapered surface 315. A person skilled in the art will also understand that more or fewer hydraulic actuators 323 may be used depending on the type of tapered slip bowl 317 used, and the number of pipe slips 319; correspondingly, a separate cylinder motor 323 couples to each pipe slip 319 in an embodiment using four pipe slips 319 in tapered slip bowl 317. In still other embodiments, pipe slips 319 of tapered slip bowl 317 may be coupled such that use of only one cylinder motor 323 is necessary.

Ram assembly 303 comprises four lifting devices 327, a setting platform 331, and three setting extensions 333. As illustrated in FIG. 7, an upper end of each lifting device 327 is coupled to the lower surface of load ring 305. A corresponding lower end of each lifting device 327 is coupled to an upper surface of setting platform 331, near an edge of setting platform 331 circumferentially equidistant from the two adjacent lifting devices 327. Preferably, lifting devices 327 comprise 3 inch hydraulic rams having a 1.5 inch rod capable of moving setting platform 331 axially approximately 1.5 feet. Lifting devices 327 are operationally coupled such that during operation of the ram assembly 303, setting platform 331 will remain level. The lifting power of each individual lifting device 327 is selected based on the particular pipe slips 319, and the particular pipe string 302 in use in a particular application. A balance must be maintained between the force necessary to appropriately raise and lower setting platform 331, the force necessary to set pipe string 302 in pipe slips 307, and the crush strength of pipe slips 319 and pipe string 302. A person skilled in the art will understand that more or fewer lifting devices 327 may be used provided that the axial force along axis 311 exerted to pull each pipe slip 319 downward is the same without overloading any individual pipe slip 319. Furthermore, a person skilled in the art will understand that lifting devices 327 may comprise other types of lifting devices such as screw lifts or the like.

Setting platform 331 couples to lifting devices 327 opposite load ring 305 as described above such that setting platform 331 may alternately move axially upward and downward along axis 311 to points of maximum and minimum axial movement of lifting devices 327. Setting platform 331 and lifting devices 327 are at a point of minimum axial movement in FIG. 7. Setting platform 331 defines an opening 337 configured to allow for pipe string 302 to pass and move through setting platform 331. Setting extensions 333 couple to an upper surface of setting platform 331 and extend toward the lower surface of load ring 305. Setting extensions 333 have a sufficient vertical length such that when lifting devices 327 are at minimal axial movement, an upper end of each setting extension 333 contacts a respective bottom of each pipe slip 319 of tapered slip bowl 317.

Setting extensions 333 may be tapered toward the end proximate to load plate 307 as shown, or alternatively not. There are three setting extensions 333 in the embodiment illustrated in FIG. 7; a setting extension 333 corresponds to each pipe slip 319 in use in tapered slip bowl 317. A person skilled in the art will understand that alternative embodiments of tapered slip bowl 317 may comprise more or fewer pipe slips 319. In those embodiments, more or fewer setting extensions 333 will be used. For example, in embodiments where tapered slip bowl 317 comprises four pipe slips 319, four setting extensions 333 will be used, one setting extension 333 proximate to and configured to engage each pipe slip 319.

Referring now to FIGS. 8-11, gripping assembly 300 operates as described herein. In the snubbing process illustrated in FIG. 8, pipe is run in to the wellbore following closure of blowout preventers in the well pressure acts to resist placement of pipe in the wellbore. A movable assembly 400 supports a pipe string 302 in central opening 309. Hydraulic actuators 323 have operated to remove pipe slips 319 out of central opening 309 allowing for axial movement of pipe string 302 within central opening 309. In addition, lifting devices 327 have operated to move setting platform 331 to the maximum lift of lifting devices 327.

Figure 9:
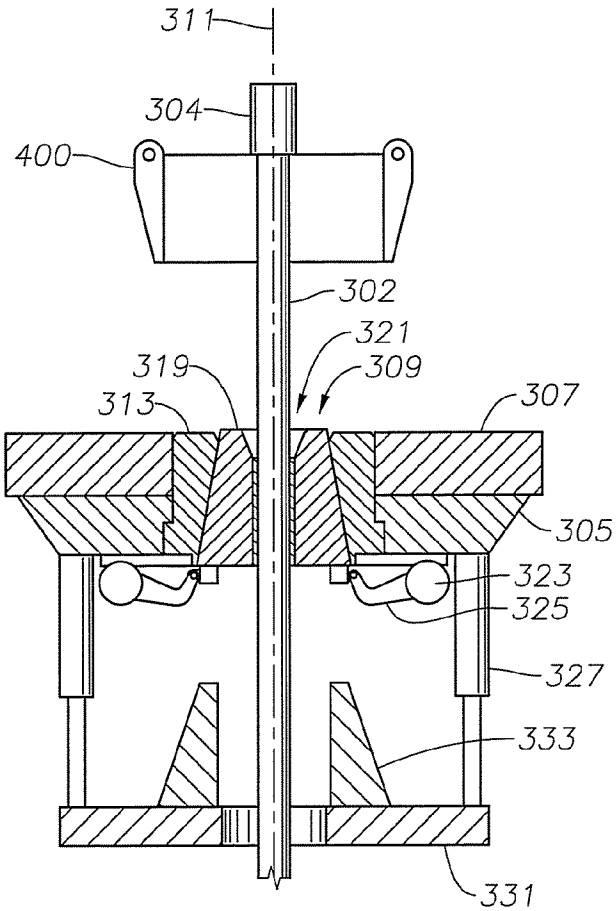
FIGS. 8-11 are sectional views of the pipe gripping assembly of FIG. 7 illustrating sequential steps in the operation of the pipe gripping assembly of FIG. 7.
Figure 8:
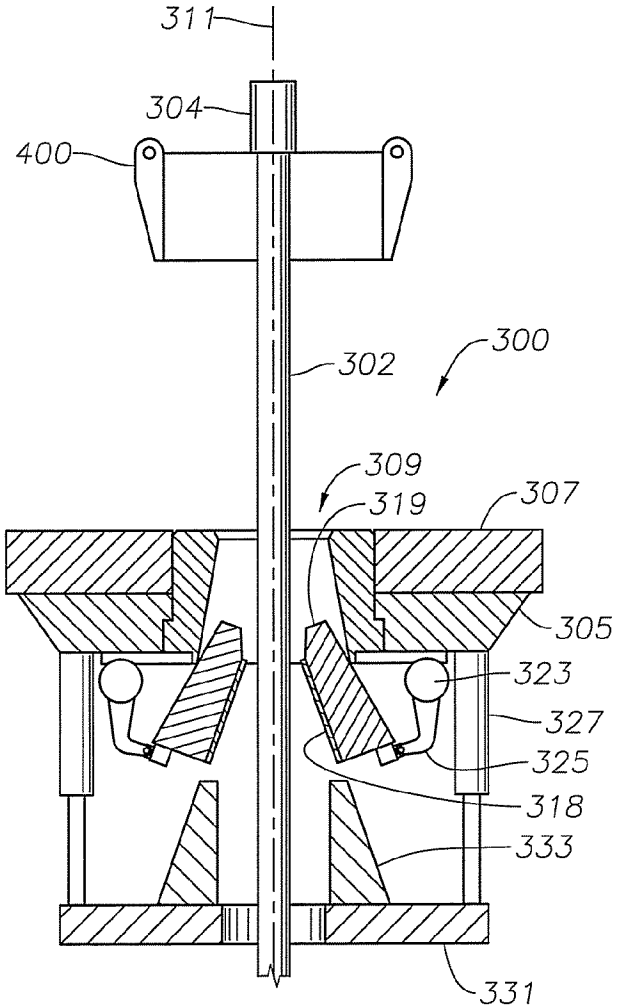

As illustrated in FIG. 9, movable assembly 400 then lowers pipe string 302 axially along axis 311 bringing collar 304 proximate to setting platform 331. Hydraulic actuators 323 are then operated again to insert pipe slips 319 into central opening 309 and define pipe opening 321. As shown, pipe string 302 substantially fills pipe opening 321. Operation of hydraulic actuators 323 as shown in FIG. 9 brings the pipe slip inserts (not shown) coupled to pipe slips 319 into contact with the surface of pipe string 302, providing initial grip of pipe string 302.

Figure 10:
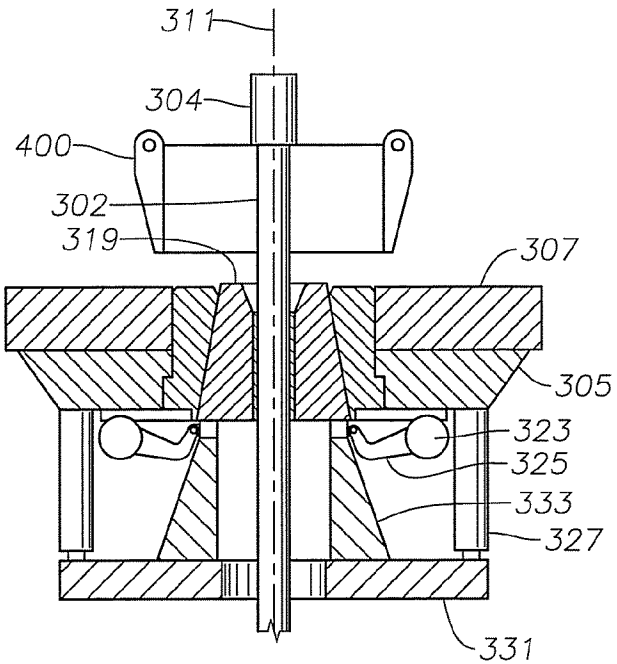

Referring now to FIG. 10, lifting devices 327 are operated in a first direction, thus moving setting platform 331 toward the lower surface of load plate 307. Moving of setting platform 331 brings a respective setting extension 333 into contact with a respective lower surface of each pipe slip 319. Lifting devices 327 then continue in the first direction axially toward from the lower surface of load ring 305 to exert an axial force upward along axis 311 through setting extensions 333 to pipe slips 319, thereby pushing pipe slips 319 against tapered surface 315. This action pushes pipe slips 319 axially upward narrowing the diameter of pipe opening 321. In response, the pipe slip inserts (not shown) coupled to pipe slips 319 come into tighter gripping contact with pipe string 302. In this manner, gripping assembly 300 comes into gripping engagement with pipe string 302. Gripping assembly 300 exerts a greater gripping force on pipe string 302 than prior art methods without requiring the use of pipe slip inserts containing teeth or friction paper proximate to pipe string 302.

Figure 11:
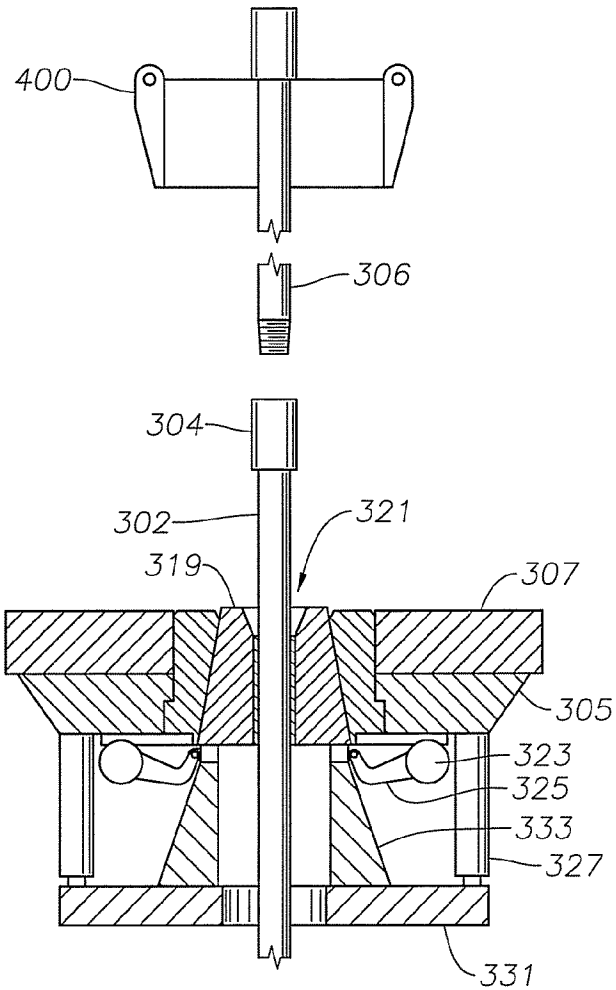

Referring now to FIG. 11, movable assembly 400 releases pipe string 302 placing the entire weight of pipe string 302 on gripping assembly 300. Gripping assembly 300 then holds pipe string 302 while movable assembly 400 retrieves an additional pipe element 306. The additional pipe element 306 is then coupled to pipe string 302 through collar 304 securing movable assembly 400 to pipe string 302. Lifting devices 327 are then operated in a second direction to release the upward axial force on pipe slips 319 and remove setting extensions 333 from contact with pipe slips 319. Hydraulic actuators 323 are then operated to remove pipe slips 319 from central opening 309, allowing movable assembly 400 to lower pipe string 302 further into a bore. The process then repeats itself beginning as described in FIG. 8.

Accordingly, the disclosed embodiments provide numerous advantages over other gripping assemblies. For example, the present invention provides a pipe slip assembly that can grip pipe without the use of pipe slip teeth or friction paper.

The present invention accomplishes this with a simple smooth faced gripping assembly for gripping pipe strings. In addition, the present invention accomplishes this without the need of a secondary gripping system that uses damaging pipe slip teeth. The present embodiment also eliminates the need for multiple movable gripping assemblies. This allows the run-in process to be accomplished with more efficiency and safety. The hydraulic ram system also allows use of heavier weight pipe strings due to the additional gripping force exerted by the pipe slips through the hydraulic rams. Embodiments of the present invention can also be used with the control line installation system and apparatus of U.S. Pat. No. 6,131,664.

While the invention has been shown or described in only some of its forms, it should be apparent to those skilled in the art that it is not so limited, but is susceptible to various changes without departing from the scope of the invention.

What is claimed is:

1. An apparatus for gripping a string of well pipe being lowered into or retrieved from a well, comprising:

pipe slips defining a central bore opening having an axis;

the pipe slips configured to abut and grip a surface of a pipe passing through the central bore opening while in a first position;

the pipe slips further configured to allow axial movement of the pipe when moved to a second position;

an actuator connected with the pipe slips for moving the slips between the first and second position; and at least one hydraulic ram device configured to exert an axial force on the pipe slips that urges the pipe slips into tighter engagement with the pipe while the pipe slips are in the first position to enhance gripping of the pipe.

2. The apparatus of claim 1, wherein the hydraulic ram device comprises:

a plurality of hydraulic rams;

a setting plate coupled to the hydraulic rams for axial movement by the hydraulic rams;

the setting plate mounted proximate to and axially spaced from the pipe slips and having an opening allowing passage of the pipe slips and the pipe through the central bore;

at least one setting plate extension extending from the setting plate toward the pipe slips and in engagement with the pipe slips while the hydraulic rams are exerting the axial force; and wherein the setting plate extension is disengaged from the pipe slips while the actuator moves the pipe sips between the first and second positions.

3. The apparatus of claim 2, wherein:

the setting plate is located above the pipe slips;

the hydraulic rams exert a downward force on the pipe slips while the pipe slips are in the first position; and the hydraulic rams are disengaged from the pip slips while the actuator moves the pipe slips between the first and second positions.

4. The apparatus of claim 2, wherein:

the setting plate is located below the pipe slips;

the hydraulic rams exert an upward force on the pipe slips while the pipe slips are in the first position; and the hydraulic rams are disengaged from the pipe slips while the actuator moves the pipe slips between the first and second positions.

5. The apparatus of claim 1, wherein the hydraulic ram device comprises:

an extension mounted to the hydraulic ram device and having end extending axially toward the pipe slips, the end of the extension being selectively moved into abutment with the slips and moved axially away from the slips while the slips remain in the first position.

6. The apparatus of claim 1, further comprising:

a conical slips bowl the carries the slips; wherein the actuator at least partially retracts the pipe slips from the slips bowl while moving toward the second position;

the actuator moves the pipe slips into the slips bowl while moving the pipe slips toward the first position; and the axial force applied by the hydraulic ram device tends to push the pipe slips further into the slips bowl after the actuator has ceased moving the slips toward the first position.

7. The apparatus of claim 2, wherein the setting plate extension has an end that is axially spaced from the pipe slips while the pipe slips are in the second position and in engagement with the pipe slips while in the first position.

8. The apparatus of claim 1, wherein a load path for the axial force passes from the hydraulic ram device to the pipe slips bypassing the portion of the pipe between the pipe slips and the hydraulic ram device.

9. An apparatus for assisting support of well pipe being lowered into or retrieved from a well, comprising:

a load ring for encircling a set of well pipe slips, the pipe slips defining a conical exterior having a larger diameter end and a smaller diameter end;

a conical bowl mounted to the load ring, the pipe slips being carried in the bowl between a released position at least partially retracted from the bowl and a gripping position inserted into the bowl;

an actuator mounted to the load ring and the pipe slips for moving the slips from the gripping position to the released position;

a setting plate defining an opening coaxial with an axis of the load ring;

a plurality of axially oriented hydraulic rams connected between the setting plate and the load ring for moving the setting plate axially relative to the load ring, the hydraulic rams being spaced around the opening; and at least one setting plate extension coupled to the setting plate and having an end configured to engage and exert an axial force on the larger diameter end of the pipe slips in response to axial movement of the hydraulic rams while the pipe slips are in the gripping position, the axial force having a load path passing through the pipes slips and into the pipe to more tightly grip the pipe.

10. The apparatus of claim 9, wherein:

the setting plate is adapted to be mounted above the pipe slips;

the end of the setting plate extension is configured to disengage from the larger diameter end of the pipe slips while the hydraulic rams move the setting plate upward from the load ring.

11. The apparatus of claim 9, wherein:

the setting plate is adapted to be mounted below the pipe slips;

the end of the setting plate extension is configured to disengage from the larger diameter end of the pipe slips while the hydraulic rams move the setting plate downward from the load ring.

12. The apparatus of claim 9, wherein the setting plate extension comprises:

a plurality of legs extending axially from the setting plate and spaced around the opening;

each of the legs has a cross-sectional area that decreases from the setting plate to a free end; and the free end of each of the legs is configured to abut one of the pipe slips after the pipe slips are in the gripping position.

13. The apparatus of claim 9, wherein the setting plate extension comprises:

a plurality of extension legs having upper ends secured to a lower side of the setting plate and lower ends adapted to abut the pipe slips after the pipe slips are in the gripping position; wherein the extension legs are spaced in a circular array around the axis;

the hydraulic rams move the setting plate between closer and farther axial positions relative to the load ring; and the actuator moves the pipe slips to the released position while the setting plate is stationary in the farther axial position.

14. The apparatus of claim 9, wherein the setting plate extension comprises:

a plurality of extension legs having lower ends secured to an upper side of the setting plate and upper ends adapted to abut the pipe slips; wherein the extension legs are spaced in a circular array around the axis;

the hydraulic rams move the setting plate between closer and farther axial positions relative to the load ring; and the actuator moves the pipe slips to the released position while the setting plate remains stationary in the farther axial position.

15. A method for gripping well pipe being run into a well, comprising:

(a) providing pipe slips defining a central bore opening having an axis and placing the pipe slips in a first position;

(b) lowering a pipe into the central bore opening while the pipe slips are in the first position;

(c) moving the pipe slips to a second position in abutment with the pipe; then (d) with a hydraulic ram device, exerting an axial force on the pipe slips, tightly gripping the pipe; and wherein the hydraulic ram device is completely disengaged from the pipe slips during step (c).

16. The method of claim 15, wherein step (a) comprises operating hydraulic actuators in a first direction.

17. The method of claim 15, wherein step (c) comprises operating hydraulic actuators in a second direction.

18. The method of claim 15, wherein step (d) comprises pushing down on the pipe slips.

19. The method of claim 15, wherein step (d) comprises pulling downward on the pipe slips.

* * * * *